US005926194A

United States Patent [19]

Hagiwara et al.

[11] Patent Number: 5,926,194

[45] Date of Patent: Jul. 20, 1999

[54] ELECTROSTATIC INK JET RECORDING DEVICE

[75] Inventors: Yoshihiro Hagiwara; Hitoshi Minemoto; Ryosuke Uematsu; Junichi Suetsugu; Kazuo Shima, all of Tokyo, Japan

[73] Assignee: NEC Corporation, Tokyo, Japan

[21] Appl. No.: 08/705,829

[22] Filed: Aug. 30, 1996

[30] Foreign Application Priority Data

Aug. 30, 1995 [JP] Japan ..... 7-221948

[51] Int. Cl.[6] ..... B41J 2/06

[52] U.S. Cl. ..... 347/55

[58] Field of Search ..... 347/55, 54

[56] References Cited

U.S. PATENT DOCUMENTS

| | | | |
|---|---|---|---|
| 5,530,464 | 6/1996 | Hiwada | 347/55 |
| 5,619,234 | 4/1997 | Nagato et al. | 347/55 |

FOREIGN PATENT DOCUMENTS

| | | | |
|---|---|---|---|
| 2160557 | 6/1990 | European Pat. Off. . | |
| 703081A2 | 3/1996 | European Pat. Off. | 347/55 |
| WO9311866 | 6/1993 | WIPO . | |

OTHER PUBLICATIONS

Patent Abstracts of Japan, vol. 18, No. 611, p. 120, JP 06–A–234219, (Okaya Electric Ind Co. Ltd) Aug. 23, 1994.

*Primary Examiner*—Benjamin R. Fuller
*Assistant Examiner*—C. Dickens
*Attorney, Agent, or Firm*—Sughrue, Mion, Zinn, Macpeak & Seas, PLLC

[57] ABSTRACT

An electrostatic ink jet recording device includes an ink chamber for storing therein a volume of ink containing charged toner particles, the ink chamber being provided with an ink outlet, an opposing electrode connected to a grounded node, the opposing electrode being arranged in opposition to the ink outlet with a sheet transfer route in between, a discharge electrode provided in a vicinity of the ink outlet for developing a first electric field between the discharge electrode and the opposing electrode to discharge a first quantity of charged toner particles as an ink jet, and an electrophoresis electrode for developing a second electric field between the electrophoresis electrode and the discharge electrode to have a second quantity of charged toner particles in the ink chamber migrate toward the ink outlet is provided an electric field control system is provided responsive to variations of the first and second quantities of toner particles to control a voltage signal imposed on the electrophoresis electrode.

15 Claims, 5 Drawing Sheets

ELECTROSTATIC INK JET RECORDING DEVICE

BACKGROUND OF THE INVENTION

The present invention generally relates to an electrostatic ink jet recording device, and particularly, to an ink jet recording device of an electrostatic type which employs liquid ink containing solid toner particles charged in a polarity and exerts thereon an electric field for discharging quantity of toner particles as an ink jet to effect a recording or printing.

DESCRIPTION OF THE RELATED ART

There are known electrostatic ink jet recording devices of a conventional type in which an electric field is exerted on charged liquid ink, causing a volume of liquid ink to be discharged as an ink jet, which flies onto a sheet of recording paper, to effect a direct recording thereon.

In the direct recording, liquid ink is directly put on the paper so that a printed character tends to be blurred with ink stains, constituting an undesirable limit to efforts for an improved recording resolution.

In recent years a new type of liquid ink has been developed containing solid toner particles charged in a polarity, accompanying yet continued efforts for developing electrostatic ink jet recording devices of an advanced type in which an electric field is exerted on the new type of ink, forcing charged toner particles to fly out for a recording.

However, there are still left various unsolved problems, such as how to minituarize the device, how to efficiently discharge a quantity of charged toner particles out of liquid ink, how to increase the accuracy of a discharge direction, and how to achieve rapid printing with quality.

The present invention has been made with such points in mind.

SUMMARY OF THE INVENTION

It therefore is an object of the present invention to provide an electrostatic ink jet recording device of an advanced type, permitting high-speed, high-quality printing at a substantially equivalent level to an electrophotographic system.

To achieve the object, a genus of the present invention provides an electrostatic ink jet recording device comprising an ink chamber for storing therein a volume of ink containing charged toner particles, the ink chamber being provided with an ink outlet, an opposing electrode connected to a grounded node, the opposing electrode being arranged in opposition to the ink outlet with a sheet transfer route in between, a discharge electrode provided in a vicinity of the ink outlet for developing a first electric field between therefrom to the opposing electrode to discharge a first quantity of charged toner particles as an ink jet, an electrophoresis electrode for developing a second electric field between therefrom to the discharge electrode to have a second quantity of charged toner particles in the ink chamber migrate toward the ink outlet, a first toner quantity measuring means for measuring the first quantity of charged toner particles, as they are discharged from the ink outlet, a second toner quantity measuring means for measuring the second quantity of charged toner particles, as they are transferred from inside the ink chamber into a region in the vicinity of the ink outlet, and a voltage control means responsive to a combination of a measurement by the first toner quantity measuring means and a measurement by the second toner quantity measuring means for controlling a voltage signal imposed on the electrophoresis electrode.

According to a species of the genus of the invention, the measurement by the first toner quantity measuring means is representative of a number of voltage pulses imposed on the discharge electrode.

According to another species of the genus of the invention, the measurement by the first toner quantity measuring means is representative of a current conducted between the opposing electrode and the grounded node.

According to another species of the genus of the invention, the measurement by the second toner quantity measuring means is representative of a current conducted through the electrophoresis electrode.

According to another species of the genus of the invention, the voltage control means is operative for controlling an interval of time in which the voltage signal is kept imposed on the electrophoresis electrode.

According to another species of the genus of the invention, the voltage control means is operative for controlling a voltage level of the voltage signal imposed on the electrophoresis electrode.

Moreover, to achieve the object, another genus of the present invention provides an electrostatic ink jet recording device comprising an ink chamber for storing therein a volume of ink containing charged toner particles, the ink chamber being provided with an ink outlet, an opposing electrode connected to a grounded node, the opposing electrode being arranged in opposition to the ink outlet with a sheet transfer route in between, a discharge electrode provided in a vicinity of the ink outlet for developing a first electric field between therefrom to the opposing electrode to discharge a variable quantity of charged toner particles as an ink jet, an electrophoresis electrode for developing a second electric field between therefrom to the discharge electrode to have a necessary quantity of charged toner particles in the ink chamber migrate toward the ink outlet, a toner consumption measuring means for measuring the variable quantity of charged toner particles, as they are discharged from the ink outlet, and a voltage control means responsive to a measurement by the toner consumption measuring means for controlling a voltage signal imposed on the electrophoresis electrode.

According to a species of this genus of the invention, the measurement by the toner consumption measuring means is representative of a current conducted between the opposing electrode and the grounded node.

According to another species of this genus of the invention, the measurement by the toner consumption measuring means is representative of a number of voltage pulses imposed on the discharge electrode.

According to another species of this genus of the invention, the voltage control means is operative for controlling a voltage level of the voltage signal imposed on the electrophoresis electrode.

According to another species of this genus of the invention, the voltage control means is operative for controlling an interval of time in which the voltage signal is kept imposed on the electrophoresis electrode.

Further, to achieve the object, another genus of the present invention provides an electrostatic ink jet recording device comprising a recording medium feed system for feeding a recording medium in a predetermined position, an ink jet recording head composed of an array of cellular head portions each including a body member defining an ink chamber provided with an ink outlet at a front end thereof, a discharge electrode exposed to a front region vicinal to the ink outlet, and an electrophoresis electrode exposed to a rear region of the ink chamber, the ink jet recording head being operable so that the ink outlet of the ink chamber of each cellular head portion of the ink jet recording head opposes the recording medium, as it is in the predetermined position, an ink supply system for supplying a circulatable flow of ink containing toner particles electrically charged in a polarity, through a fluid circuit including the ink chamber of each cellular head portion of the ink jet recording head, and an electric field generation system operative for providing a selective one of the cellular head portions of the ink jet recording head with a first potential field developed between the front region vicinal to the ink outlet and an opposing region vicinal to the recording medium, as it is in the predetermined position, to have a first quantity of toner particles discharged from the ink outlet onto the recording medium, and a second potential field developed between the rear region of the ink chamber and the front region to have a second quantity of toner particles transferred from inside the ink chamber to the front region, the electric field generation system comprising an opposing electrode provided in the opposing region, kept in contact with the recording medium, as it is in the predetermined position, and connected to a grounded node, the discharge electrode of each cellular head portion of the ink recording head, the electrophoresis electrode of each cellular head portion of the ink recording head, and electric field control means for imposing a voltage signal and a voltage pulse on the electrophoresis electrode and the discharge electrode of the selective cellular head portion, respectively, to develop the first and second potential fields, the electric field control means being responsive to a variation of the first quantity of toner particles to control the voltage signal imposed on the electrophoresis electrode of the selective cellular head portion so that the first quantity of toner particles is controlled.

According to a species of this genus of the invention, the variation of the first quantity of toner particles is detected by measuring a number of voltage pulses imposed on the discharge electrode of the selective cellular head portion.

According to another species of this genus of the invention, the variation of the first quantity of toner particles is detected by measuring an electric current conducted through the electrophoresis electrode of the selective cellular head portion.

According to another species of this genus of the invention, the variation of the first quantity of toner particles is detected by measuring an electric current conducted between the opposing electrode and the grounded node in response to the voltage pulse imposed on the discharge electrode of the selective cellular head portion.

Therefore, according to a genus of the invention, a first toner quantity measuring means is operative as a toner consumption measuring means to give a measurement representative of a quantity of charged toner particles as a short in a vicinity of an ink discharge outlet, due to an ink discharge, and a voltage control means is responsive thereto to estimate a target value representative of a necessary quantity of charged toner particles for a supplementation to the vicinity of the ink discharge outlet. Then, the voltage control means imposes a voltage signal, e.g. a preset voltage, on an electrophoresis electrode, causing charged toner particles in an ink chamber to migrate toward the ink discharge outlet. Concurrently, a second toner quantity measuring means is operative as a toner transfer quantity measuring means to give a measurement representative of a current quantity of charged toner particles transferred from inside the ink chamber to the vicinity of the ink discharge outlet. The voltage control means is responsive thereto so that the voltage signal imposed on the electrophoresis electrode is controlled to stop the transfer of toner particles, as the current quantity has reached the necessary quantity.

According to another genus of the invention, a toner consumption measuring means gives a measurement representative of a quantity of charged toner particles as a short in a vicinity of an ink discharge outlet, due to an ink discharge, whereto a voltage control means is responsive to control a voltage signal, e.g. a variable voltage, imposed on an electrophoresis electrode, thereby controlling a quantity of charged toner particles transferred from inside an ink chamber to a vicinity of an ink discharge outlet.

According to another genus of the invention, at a selective cellular portion of an ink jet recording head of an electrostatic ink jet recording device, a quantity of charged toner particles to be discharged from an ink outlet to a recording paper is controlled in dependence on a variation of a quantity of charged toner particles discharged from the ink outlet to the recording paper.

According to a species of the invention, a discharge electrode is supplied with a sequence of voltage pulses for activating a discharge of charged toner particles as an ink jet, and a total number of voltage pulses imposed on the discharge electrode exemplarily in a unit time is counted to provide a measurement representative of a quantity of consumed toner particles, which is employed to control a voltage signal imposed on an electrophoresis electrode.

According to another species of the invention, an electric current is measured between an opposing electrode and a grounded node in response to a voltage pulse imposed on a discharge electrode, and is integrated exemplarily for a unit time to provide a measurement representative of a quantity of consumed toner particles, which is employed to control a voltage signal imposed on an electrophoresis electrode.

According to another species of the invention, an electrophoresis electrode is applied with a voltage signal causing a quantity of toner particles charged in a polarity to electrically migrate from inside of an ink chamber toward an ink discharge outlet and a quantity of counter ions generated by an ink discharge with a reverse polarity to the toner particles to migrate from a vicinity of the ink discharge outlet toward the electrophoresis electrode, so that a correspondent current is conducted through the electrophoresis electrode, which current is measured as it represents a quantity of charged toner particles transferred from inside the ink chamber to the vicinity of the ink discharge outlet.

According to another species of the invention, in a unit time, as a ratio thereto of a voltage imposing time in which a voltage signal is kept imposed on an electrophoresis electrode is increased, accelerating an electrophoresis of charged toner particles, an ink discharge outlet has an increased quantity of toner particles transferred to a vicinity thereof in the unit time. The quantity of transferred toner particles is decreased, as the ratio of the voltage imposing time to the unit time is decreased.

According to another species of the invention, a voltage signal imposed on an electrophoresis electrode has a controllable voltage level for developing an electric field with a variable tendency to activate an electrophoresis of charged toner particles so that a vicinity of an ink discharge outlet has a variable quantity of transferred toner particles.

BRIEF DESCRIPTION OF THE DRAWINGS

The objects, features and advantages of the present invention will become more apparent from consideration of the following detailed description, in conjunction with the accompanying drawings, in which.

DESCRIPTION OF THE PREFERRED EMBODIMENTS

Figure 1A:
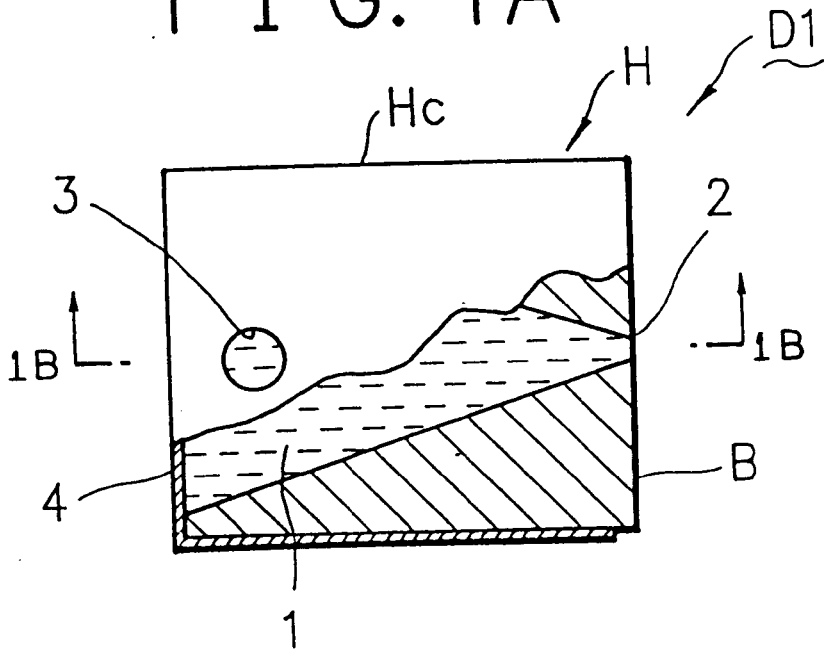
FIG. 1A is an elevation, partly in section, of an essential portion of an ink jet recording head of an electrostatic ink jet recording device according to an embodiment of the invention.

There will be detailed below the preferred embodiments of the present invention, with reference to the accompanying drawings. Like members are designated by like reference characters.

Figure 1B:
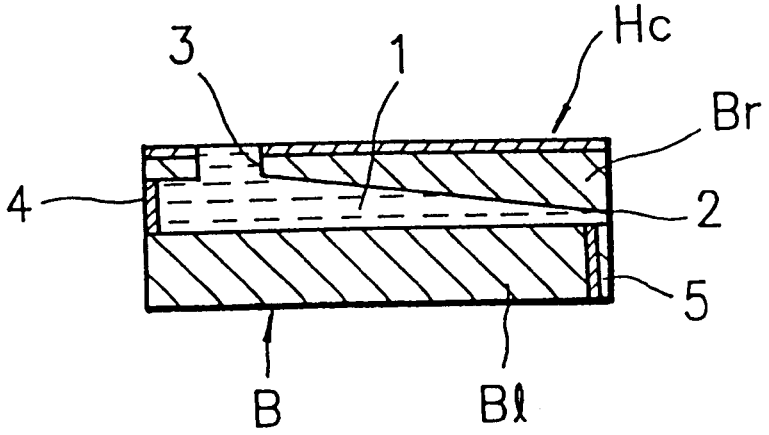
FIG. 1B is a section along line 1B—1B of FIG. 1A.

FIG. 1A shows an essential portion of an ink jet recording head H of an electrostatic ink jet recording device D1 according to an embodiment of the invention; FIG. 1B, an 1B—1B section of FIG. 1A; and FIG. 2, an electric field generation system of the ink jet recording device D1.

Figure 2:
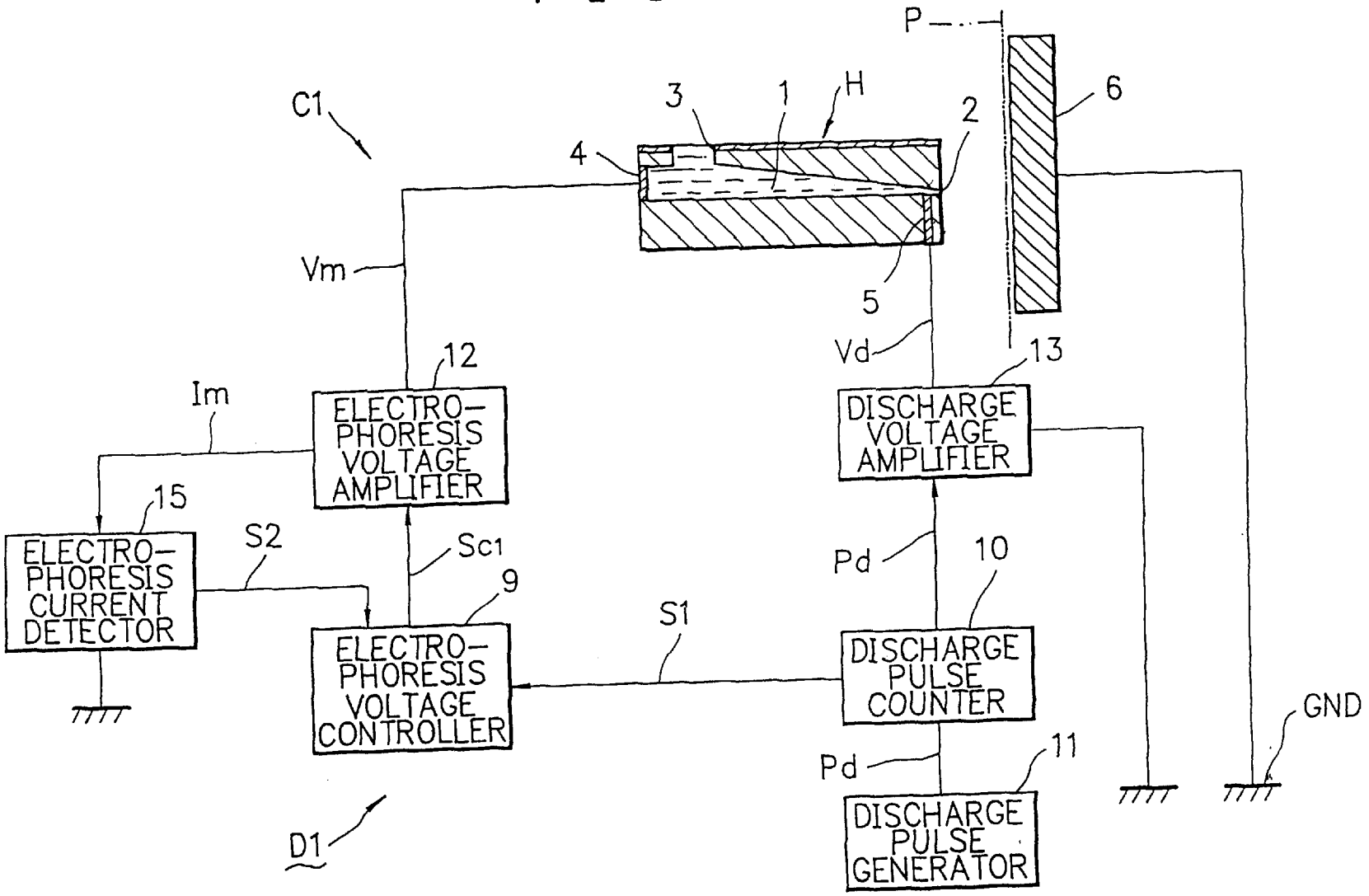
FIG. 2 is a block diagram of an electric field generation system of the electrostatic ink jet recording device according to the embodiment.

The ink jet recording device D1 comprises: an unshown sheet feed system for feeding a sheet of recording paper P (FIG. 2) in a predetermined position; the ink jet recording head H including an array of cellular head portions Hc of which an arbitrary one is illustrated in FIGS. 1A and 1B and applicable in opposition to the recording paper P, as it is put in the predetermined position, as shown in FIG. 2; an ink supply system for supplying the recording head H with a circulatable flow of liquid ink containing toner particles charged in an apparently positive polarity due to a zeta potential or a negative polarity; a electric field generation system for generating an electric potential field along a longitudinal axis of each cellular head portion Hc, the field generation system including an electric field control system C1 for controlling the potential field; and an unshown controller for controlling the sheet feed system, the recording head H, the ink supply system and the field generation system in a synchronized manner.

The sheet feed system may include a sheet transfer mechanism adapted for an automatic transfer of the recording paper P, or a platen of which an outside diameter portion may be composed of a cylindrical conductive member as a later-described grounded opposing electrode (6, FIG. 2) for rolling up and down the recording paper P which may thus have a grounded potential.

The recording device D1 may be a serial print type so that the recording head H may be carriable along a platen, or alternately may be a line print type so that the recording head H may be fixed in position.

Each cellular head portion Hc comprises: a substantially hexahedral body member B formed with an internal substantially wedge-shaped cavity in a right half portion Br thereof to define an ink chamber 1, which has an ink supply inlet 3 in a right side thereof and an ink discharge outlet 2 at a front end thereof, so that the chamber 1 is tapered with an ascending slope at a bottom side, a descending slope at a top side and a leftwardly approaching slope at the right side, while a left side is non-tapered, as it straightly extends in a longitudinal direction; an electrophoresis electrode 4 constituting a rear wall of the ink chamber 1 and covering a bottom surface and a right side surface of the right half portion Br of the body member B; and a discharge electrode 5 transversely provided through a front end part of a left half portion B l of the body member B so that a right end of the discharge electrode 5 is exposed to the ink chamber 1 at a slightly rearwardly offset position relative to the ink outlet 2.

The ink supply system includes an unshown ink cartridge, an unshown common ink pump, the ink supply inlet 3, and the ink chamber 1 provided with the ink discharge outlet 2.

The electric field generation system comprises: a combination of potential field generating components including the electrophoresis electrode 4 and the discharge electrode 5 of each cellular head portion Hc, and a grounded opposing electrode 6 commonly provided for the respective cellular portions Hc of the recording head H; and the electric field control system C1 including a discharge pulse generator 11, a discharge pulse counter 10, a discharge voltage amplifier 13, an electrophoresis current detector 15, an electrophoresis voltage controller 9 and an electrophoresis voltage amplifier 12.

The field control system C1 may be controlled in a time-dividing manner to cover an entirety of or a cell block in the recording head H, or may be provided for a respective cellular head portion Hc. The control system C1 may further include a set of switching circuits controlled from the controller, for a connection of the system C1 with the potential field generating components to effect an independent or selective driving of the respective cellular portions Hc of the recording head H.

In other words, as shown in FIGS. 1A, 1B and 2, the electrostatic ink jet recording device D1 includes: an ink chamber 1 implemented for storing therein a volume of ink containing charged toner particles, and provided with an ink discharge outlet 2; an opposing electrode 6 connected to a grounded node GND, and arranged in opposition to the ink outlet 2 with a sheet transfer route interposed therebetween for feeding a sheet of recording paper P; a discharge electrode 5 provided in a vicinity of the ink outlet 2 for developing an electric field between therefrom to the opposing electrode 6 to discharge a quantity of charged toner particles as an ink jet; and an electrophoresis electrode 4 for developing an electric field between therefrom to the discharge electrode 5 to have a quantity of charged toner particles in the ink chamber 1 migrate toward the ink outlet 2.

The ink chamber 1 is defined as a cavity formed in a dielectric body member B, and has the ink outlet 2 as part thereof through which an inside of the chamber 1 communicates with the outside. Designated at reference character 3 is an ink supply inlet.

The electrophoresis electrode 4 is exposed in part to the ink chamber 1, while a remaing portion thereof encloses the chamber 1 from outside the body member B, except a body part including the ink outlet 2.

The discharge electrode 5 is stripe-shaped with its one end disposed at a location slightly rearwardly offset from the ink outlet 2, which electrode end is pointed like a needle to achieve an effective concentration of a divergent electric field.

For an intended recording, the employed ink contains a system of toner particles as thermoplastic fine particles colored and dispersed together with a charge controlling agent in a petroleum organic solvent (an isoparaffin) so that the particles are charged in an apparently positive polarity due to a zeta potential.

The ink jet recording device D1 further includes: a discharge pulse counter 10 as a first toner quantity measuring means or toner consumption measuring means for measuring the quantity of charged toner particles discharged from the ink outlet 2; an electrophoresis current detector 15 as a second toner quantity measuring means or toner transfer quantity measuring means for measuring the quantity of charged toner particles transferred from inside the ink chamber into a region vicinal to the ink outlet 2; and an electrophoresis voltage controller 9 as a control means responsive to a combination of a signal S1 representative of a result of the measurement by the discharge pulse counter 10 and a signal S2 representative of a result of the measurement by the electrophoresis current detector 15, to output a controlled signal Sc1 to be amplified and imposed as a voltage signal Vm on the electrophoresis electrode 4.

In the present embodiment, the discharge pulse counter 10 is adapted for counting a number of (discharge) voltage pulses Pd to be amplified and imposed as non-continuous voltages (or discharge pulses) Vd on the discharge electrode 5, to thereby detect a quantity of charged toner particles dischargeable from the ink outlet 2. The electrophoresis current detector 15 is adapted for measuring an electric current Im conducted through the electrophoresis electrode 4, to thereby detect a quantity of counter ions having migrated from a chamber-front region in a vicinity of the ink outlet 2 to the electrophoresis electrode 4, as the quantity of charged toner particles transferred from inside the ink chamber 1 to the region vicinal to the ink outlet 2. The electrophoresis voltage controller 9 is adapted to control a voltage imposing time in which the voltage signal Vm is imposed on the electrophoresis electrode 4 with a preset voltage level and a polarity identical to the toner particles.

More specifically, in the electric field generation system C1, the discharge pulse counter 10 is engaged with an interconnection line between a discharge pulse generator 11, which outputs a sequence of intermittent voltage pulses Pd in accordance with externally input print data, and a discharge voltage amplifier 13 which amplifies the voltage pulses Pd from the discharge pulse generator 11 to provide the discharge pulses Vd. Accordingly, a discharge voltage pulse (Pd, Vd) is generated at the generator 11, counted at the counter 10 and amplified to a required level at the amplifier 13, to be imposed on the discharge electrode 5. The pulse counter 10 counts up a total Np (FIG. 3A) of voltage pulses Pd output from the pulse generator 11 every unit time ΔT, which count value Np is informed by the signal S1 to the electrophoresis voltage controller 9 each time the unit time ΔT has elapsed. The pulse generator 11 has a minimum pulse-generation period set within a range of $10^{-3}$ to $10^{-4}$ sec.

The electrophoresis voltage controller 9 is implemented for a first function of responding to the count value Np of voltage pulses Pd in unit time ΔT, as it is informed from the discharge pulse counter 10, to provide a target value in proportion thereto as a quantity of toner particles to be transferred, a second function of comparing the target quantity of toner particles to be transferred with a current quantity of transferred toner particles, as it is informed by a signal S2 from the electrophoresis current detector 15, and a third function of outputting a controlled voltage signal Sc1 to be amplified at an electrophoresis voltage amplifier 12 to provide the electrophoresis voltage signal Vm that has a high level established at an initial point of each unit time ΔT and switched to a low level when the current quantity of transferred toner particles informed from the electrophoresis current detector 15 has reached, i.e. become equivalent to, the target quantity of toner particles to be transferred. The low level voltage is controlled in synchronism with a potential variation of the discharge electrode 5, to have always the same potential as a potential of the discharge electrode 5.

The electrophoresis current detector 15 is adapted to integrate a measured value of the current Im conducted through the electrophoresis electrode 4 with respect to a concerned unit time ΔT, continuously informing the electrophoresis voltage controller 9 of a current integrated value as the current quantity of transferred toner particles, while the integrated value is reset to a null every unit time ΔT.

The discharge pulse counter 10, the electrophoresis voltage controller 9 and the electrophoresis current detector 15 thus have the unit time ΔT common thereto as a temporal unit of their actions, which is put under control of an unshown main controller of the device D1 that governs timings of those actions. The unit time ΔT may be set to 0.1 sec. or near as a by far longer period than a generation period of the voltage pulse Pd.

Figure 3A:
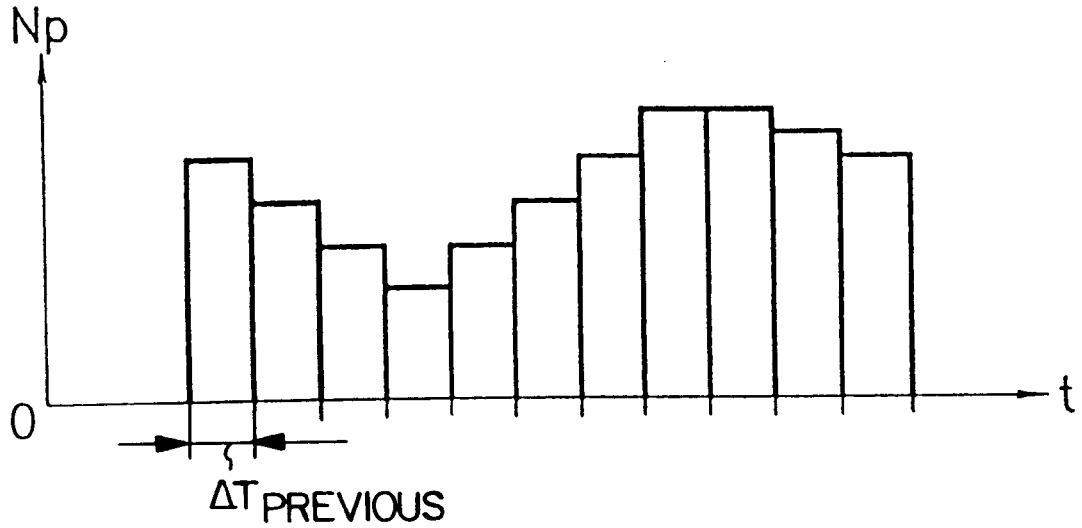
FIGS. 3A and 3B show time charts of principal signals associated with actions of an electric field control system of the electric field generation system of FIG. 2.
Figure 3B:
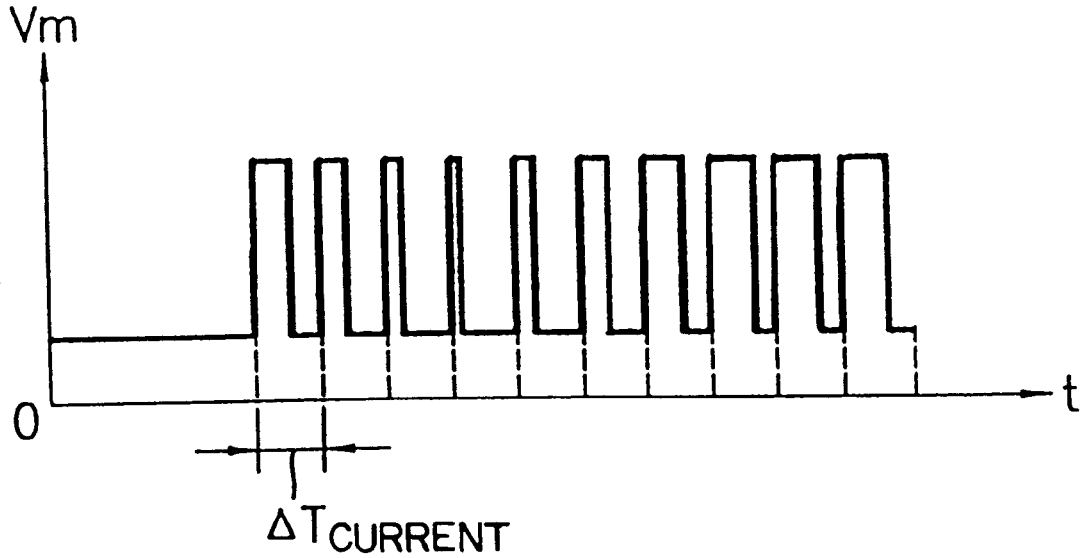

There will be described below actions of the recording device D1, with reference to FIGS. 2, 3A, and 3B.

In operation, the ink chamber 1 is supplied with a sufficient volume of ink. The electrophoresis voltage controller 9 outputs the controlled signal Sc1 at a high level for a predetermined period of time to the electrophoresis voltage amplifier 12, where it is amplified to be imposed as an electrophoresis voltage Vm on the electrophoresis electrode 4. The electrophoresis electrode 4 cooperates with the discharge electrode 5 to have an electric potential field developed therebetween, causing a quantity of charged toner particles to migrate so that they are transferred from inside the ink chamber 1 to a vicinity of the ink outlet 2.

In this respect, as the predetermined period has elapsed, the electrophoresis voltage controller 9 outputs a low level voltage for providing the electrophoresis electrode 4 with the same potential as the discharge electrode 5, to stop the electrophoresis of charged toner particles toward the ink outlet 2 so that their transfer is interrupted.

As the device D1 is put to a printing operation, the discharge pulse generator 11 outputs a first voltage pulse Pd to the discharge voltage amplifier 13, where it is amplified to be imposed as a voltage pulse Vd on the discharge electrode 5. The discharge electrode 5 thus has a potential difference relative to the opposing electrode 6, cooperating therewith to have an electric potential field developed therebetween, causing charged toner particles in ink between the discharge electrode 5 and the ink outlet 2 to be concentrated close to or in an ink meniscus formed at the ink outlet 2 so that, when tensile forces along the ink meniscus are overcome, the concentrated toner particles are released out of the ink outlet 2, flying as an ink jet toward the opposing electrode 6. The flying toner particles are caught on a recording paper P in front of the opposing electrode 6, where they are deposited to be thermally fixed in an unshown fixing section. As the discharge electrode 5 is applied with a sequence of intermittent voltage pulses Vd, such a deposition of toner particles is repeated on the paper P to effect an intended printing.

As charged toner particles are discharged from the ink outlet 2, a vicinity thereof becomes short of charged toner partcles. Concurrently, a vicinal region to the ink outlet 2 has a quantity of counter ions generated in ink therein due to the toner discharge, which ions may preferably be removed or otherwise might adversely affect an electric field developed for toner transfer between the electrophoresis and discharge electrodes 4 and 5.

For a desirable continuous discharge of toner particles, the ink outlet region should be kept supplied with an adequate quantity of charged toner particles. An insufficient quantity of supplied toner particles may cause a toner discharge failure, even when a voltage pulse Vd is imposed on the discharge electrode 5. An excessive quantity of supplied toner particles may result in inconveniences such as a blocking of the ink outlet 2.

In each unit time ΔT, the voltage pulses Vd imposed on the discharge electrode 5 are counted by the discharge pulse counter 10, which outputs the signal S1 representative of a count value at a final point of the unit time ΔT to the electrophoresis voltage controller 9. With the count value of voltage pulses Vd informed, the electrophoresis voltage controller 9 performs a proportional calculation to determine, as a target, a necessary quantity of charged toner particles to be transferred to compensate for a toner shortage at the ink outlet 2, while the calculation is based on a proportional coefficient empirically predetermined for an optimal estimation of target value.

As the target transfer quantity is calculated, the electrophoresis voltage controller 9 outputs the electrophoresis voltage signal Vm at a high level so that the electrophoresis electrode 4 has a corresponding potential difference relative to the discharge electrode 5, cooperating therewith to have an electric potential field developed therebetween, causing a quantity of charged toner particles to be transferred from inside the ink chamber 1 toward the ink outlet 2 and a quantity of counter ions generated near the ink outlet 2 to move toward the electrophoresis electrode 4. A vicinity of the ink outlet 2 is thus supplied with charged toner particles. Concurrently, counter ions reach the electrophoresis electrode 4, where they electrically discharge so that a corresponding discharge current is conducted as an electrophoresis current Im between the electrophoresis electrode 1 and a ground, which current Im flows through the electrophoresis current detector 15, where it is detected to be integrated every minute sub-division of the concerned unit timeΔT, to sequentially output results of integration as information on a current toner transfer quantity to the electrophoresis voltage controller 9.

The electrophoresis voltage controller 9 sequentially compares the current toner transfer quantity information from the electrophoresis current detector 15 with the target toner transfer quantity calculated in advance, to switch over the voltage signal Vm from the high level to a low level when the target transfer quantity is exceeded by the current transfer quantity.

Accordingly, the electrophoresis electrode 4 is set to the same potential as the discharge electrode 5, stopping the transfer of charged toner particles.

The above-described toner transfer actions are repeated every unit time ΔT. If the dicharge electrode 5 is applied with a sequence of voltage pulses Vd of which a count value Np per unit time ΔT is varied with time t as shown in FIG. 3A, then the voltage signal Vm imposed on the electrophoresis electrode 4 is controlled as shown in FIG. 3B, in which the voltage signal Vm imposed on the electrophoresis electrode 4 in a current unit time ΔT ($\Delta T_{current}$) is controlled in response to the number Np of voltage pulses Vd imposed on the dicharge electrode 5 in a previous unit time ΔT ($\Delta T_{previous}$), i.e. the voltage signal Vm is kept at a high level for a duration period in the current unit timeΔT ($\Delta T_{current}$) that is variable in dependence on the pulse number Np in the previous unit time ΔT ($\Delta T_{previous}$).

According to the present embodiment, an electrophoresis voltage controller 9 is operative as a control means for controlling an imposed voltage Vm on an electrophoresis electrode 4 in accordance with an output of a discharge pulse counter 10 as a toner consumption measuring means so that an adequate quantity of charged toner particles is transferred to a vicinity of an ink outlet 4 in accordance with a quantity of toner particles consumed at the ink outlet 2 due to an ink discharge, permitting a stable toner discharge to be continuously effected, achieving a stable printing with a competent quality.

Moreover, according to the embodiment, an imposed voltage Vm on an electrophoresis electrode 4 is controlled in accordance with a combination of an output of the discharge pulse counter 10 and an output of an electrophoresis current detector 15 as a toner transfer quantity measuring means so that the voltage Vm of the electrophoresis electrode 4 is controllable in accordance with a quantity of actually transferred toner particles, permitting a toner transfer with a high reliability.

Further, in the embodiment, a toner consumption is estimated by counting a number of voltage pulses Vd imposed on a discharge electrode 5 in a unit time ΔT, permitting a stable measurement of toner consumption.

Still further, the embodiment employs an electrophoresis current detector 15 for measuring a discharge current of counter ions that is conducted through an electrophoresis electrode 4 in correspondence to a quantity of transferred toner particles, to output a measurement result as a current toner transfer quantity to an electrophoresis voltage controller 9, where it is compared with a target toner transfer quantity to find a match therebetween for which an imposed voltage Vm on an electrophoresis electrode 4 is controlled, thus permitting an effective control with high reliability, in particular for an optimum quantity of charged toner particles to be transferred to a vicinity of an ink outlet 2. In addition, the counter ions generated in a region vicinal to the ink outlet 2 are effectively dischargeable, preventing undesirable influences that otherwise might be caused in the electric field between the electrophoresis electrode 4 and a discharge electrode 5.

Also, in the embodiment, an electrophoresis voltage controller 9 controls a duration period of an imposed voltage Vm on an electrophoresis electrode 4 to thereby control a quantity of charged toner particles to be transferred, so that a voltage imposing circuit may be turned on and off to effect the voltage imposition on the electrophoresis electrode 4, permitting a facilitated fabrication of the voltage imposing circuit with a reduced cost.

Figure 4:
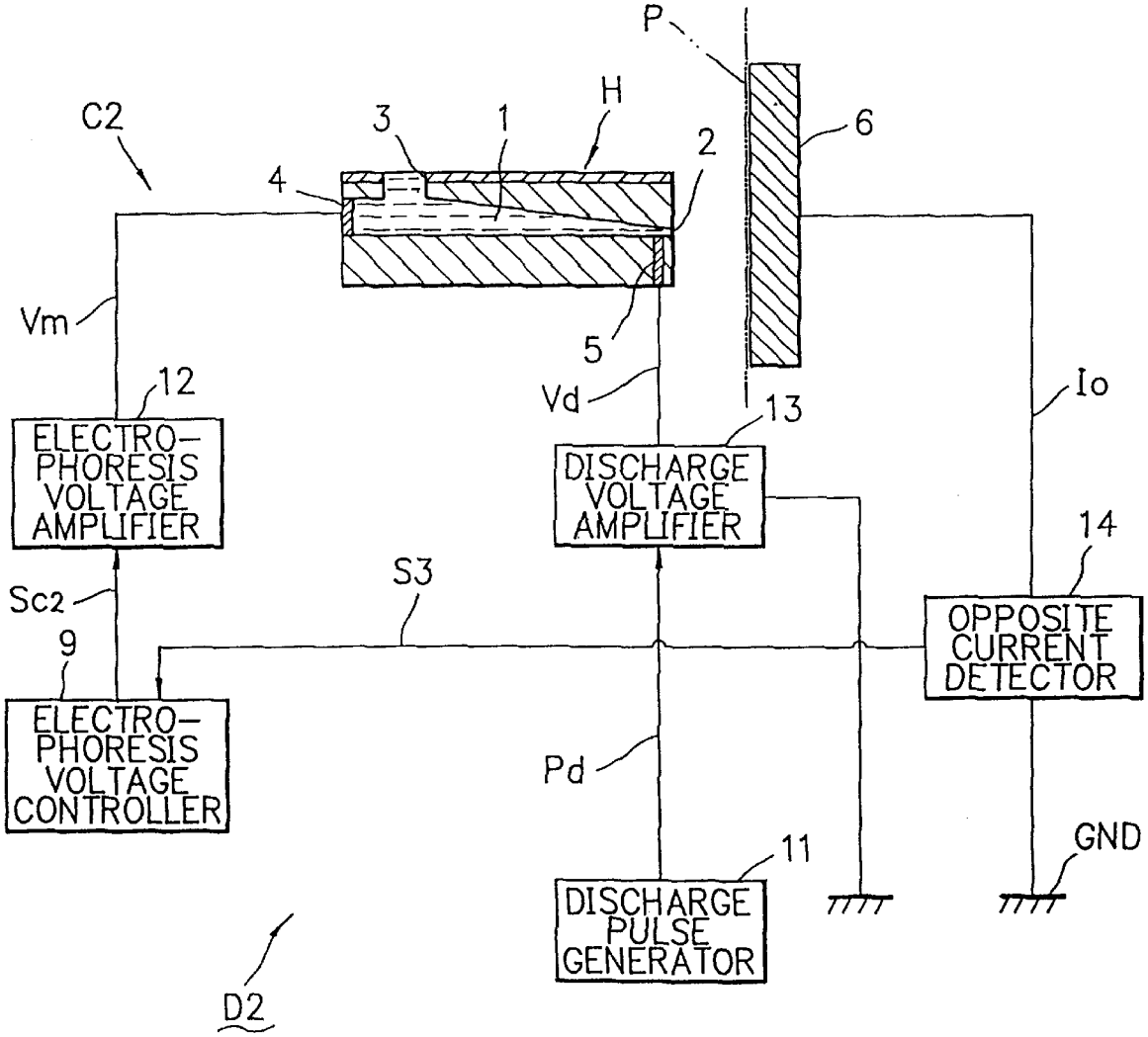
FIG. 4 is a block diagram of an electric field generation system of an electrostatic ink jet recording device according to another embodiment of the invention.
Figure 5A:
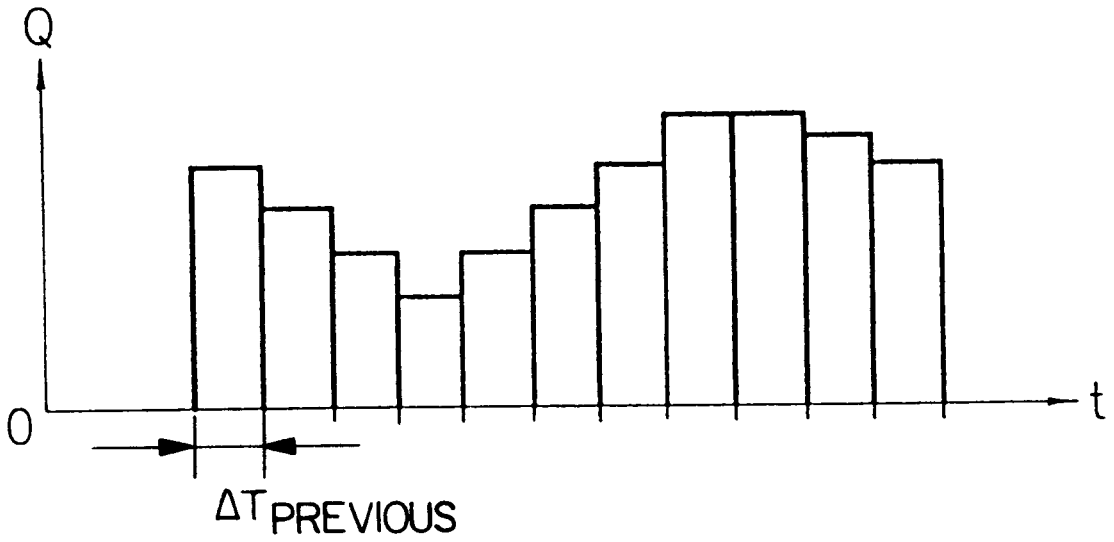
FIGS. 5A and 5B show time charts of principal signals associated with actions of an electric field control system of the electric field generation system of FIG. 4.
Figure 5B:
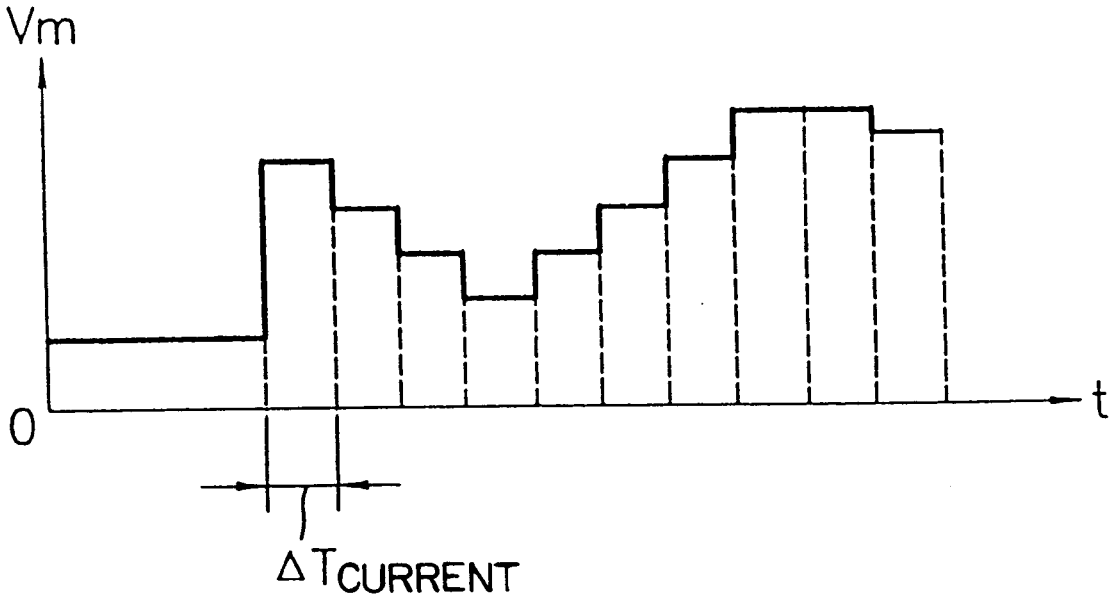

FIG. 4 shows an electric field generation system of an electrostatic ink jet recording device D2 according to another embodiment of the invention, and FIGS. 5A and 5B, time charts of principal signals associated with actions of an electric field control system C2 of the electric field generation system of FIG. 4.

The recording device D2 has, as a toner consumption measuring means in place of the discharge pulse counter 10 in the previous embodiment D1. an opposite current detector 14 engaged with an interconnection line between an opposing electrode 6 and a grounded node GND, for detecting a counter or opposite current Io conducted therebetween in response to voltage pulses Vd imposed on a discharge electrode 5 in a unit time ΔT, to output a signal S3 representative of a total quantity Q of the current Io in the unit time ΔT, as a toner consumption.

The recording device D2 does not include the electrophoresis current detector 15 of the previous embodiment D1. In the recording device D2, an electrophoresis voltage controller 9 is implemented as a control means to exhibit a function of outputting a controlled voltage Sc2 determined every unit time ΔT by a proportional calculation dependent on a measured total quantity Q of current Io conducted between the opposing electrode 6 and the grounded node GND.

Other arrangements of the recording device D2 are analogous to those of the previous embodiment D1.

As a voltage pulse Vd is imposed on a discharge electrode 5, the opposing electrode 6 has a corresponding quantity of electric charges induced thereon, causing a corresponding current Io to be conducted between the opposing electrode 6 and the grounded node GND, which current Io is measured by the opposite current detector 14, where the measurement is integrated during a unit time ΔT, to output a result of integration as the signal S3 representative of a quantity of toner particles consumed, at a final point of the concerned unit time ΔT, to the electrophoresis voltage controller 9, where it is multiplied by an empirically predetermined proportional coefficient to determine a level of the voltage signal Vm to be imposed on an electrophoresis electrode 4, so that the controlled voltage Sc2 is output at a corresponding level.

If the total quantity Q of the current Io conducted between the opposing electrode 6 and the grounded node GND is varied every unit time ΔT as shown in FIG. 5A, then the voltage signal Vm imposed on the electrophoresis electrode 4 is controlled as shown in FIG. 5B, in which the voltage signal Vm imposed on the electrophoresis electrode 4 in a current unit time ΔT(ΔTcurrent) is controlled in response to the total quantity Q of the current Io measured by the opposite current detector 14 in a previous unit time ΔT(ΔTprevious). i.e. the imposed voltage Vm on the electrophoresis electrode 4 has a higher or lower level, as the total quantity Q of the measured current Io is increased or decreased, respectively.

Therefore, according to the present embodiment. an electrophoresis voltage controller 9 is operative as a control means for controlling an imposed voltage Vm on an electrophoresis electrode 4 in accordance with an output of an opposite current detector 14 as a toner consumption measuring means so that an adequate quantity of charged toner particles is transferred to a vicinity of an ink outlet 2 in accordance with a quantity of toner particles consumed at the ink outlet 2 due to an ink discharge, permitting a stable toner discharge to be continuously effected, achieving stable printing with good quality.

Moreover, according to the embodiment, an opposite current detector 14 is operative as a toner consumption measuring means for estimating a quantity of consumed toner particles by measuring a current Io conducted between an opposing electrode 6 and a grounded node GND in response to a discharge voltage pulse Vd imposed on a discharge electrode 5, permitting a toner consumption to be estimated in accordance with an ink discharge, with a relatively high accuracy.

Further, the embodiment employs an electrophoresis voltage controller 9 for controlling a voltage level of an imposed voltage Vm on an electrophoresis electrode 4, permitting a fine and sharp control to be effected, and a reduced burden on a voltage imposing circuit in comparison with an on-off control of a preset voltage.

It will be seen that the recording device D1 may employ an opposite current detector 14 as a toner consumption measuring means in place of the discharge pulse counter 10, and that the recording device D2 may employ a discharge pulse counter 10 in place of the opposite current detector 14.

Incidentally, the foregoing embodiments D1, D2 may be modified to provide an electrostatic ink jet recording device comprising a recording medium feed system for feeding a recording medium (P) in a predetermined position; an ink jet recording head (H) composed of an array of cellular head portions (Hc) each including a body member (B) defining an ink chamber (1) provided with an ink outlet (2) at a front end thereof, a discharge electrode (5) exposed to a front region vicinal to the ink outlet (2), and an electrophoresis electrode (4) exposed to a rear region of the ink chamber (1), the ink jet recording head (H) being disposed so that the ink outlet (2) of the ink chamber (1) of each cellular head portion (Hc) of the ink jet recording head (H) opposes the recording medium (P), when it is in a predetermined position; an ink supply system (1, 3) for supplying a circulatable flow of ink containing toner particles electrically charged in a polarity, through a fluid circuit including the ink chamber (1) of each cellular head portion (Hc) of the ink jet recording head (H); and an electric field generation system (4, 5, 6, GND, C1; C2) operative for providing a selective one of the cellular head portions (Hc) of the ink jet recording head (H) with a first potential field developed between said front region vicinal to the ink outlet (2) and an opposing region vicinal to the recording medium (P), as it is in the predetermined position, to have a first quantity of toner particles discharged from the ink outlet (2) onto the recording medium (P) and a second potential field developed between said rear region of the ink chamber (1) and said front region to have a second quantity of toner particles transferred from inside the ink chamber (1) to said front region, the electric field generation system comprising an opposing electrode (6) provided in said opposing region, kept in contact with the recording medium (P), when it is in the predetermined position, and connected to a grounded node (GND), the discharge electrode (5) of each cellular head portion (Hc) of said ink recording head (H), the electrophoresis electrode (4) of each cellular head portion (Hc) of said ink recording head (H), and electric field control means (C1; C2) for imposing a voltage signal (Vm) and a voltage pulse (Vd) on the electrophoresis electrode (4) and the discharge electrode (5) of the selective cellular head portion (Hc), respectively, to develop the first and second potential fields, the electric field control means (C1; C2) being responsive to a variation (S1, S2; S3) of the first quantity of toner particles to control the voltage signal (Vm) imposed on the electrophoresis electrode (4) of the selective cellular head portion (Hc) so that the first quantity of toner particles is controlled.

In the modification, the variation of the first quantity of toner particles may be detected by measuring a number of voltage pulses (Vd) imposed on the discharge electrode (5) of the selective cellular head portion (Hc), by measuring an electric current (Im) conducted through the electrophoresis electrode (4) of the selective cellular head portion (Hc), or by measuring an electric current (Io) conducted between the opposing electrode (6) and the grounded node (GND) in response to the voltage pulse (Vd) imposed on the discharge electrode (5) of the selective cellular head portion (Hc).

It will be seen that in the modification the recording paper (P) may not be brought into contact with the opposing electrode (6).

As will be understood from the foregoing embodiments, according to a genus of the invention, an electrophoresis voltage control means controls an imposed voltage on an electrophoresis electrode so that an adequate quantity of charged toner particles is transferred to a vicinity of an ink outlet in accordance with a quantity of toner particles consumed at the ink outlet due to an ink discharge, permitting a stable toner discharge to be continuously effected, achieving a stable printing with a competent quality.

According to a species of the invention, an imposed voltage on an electrophoresis electrode is controlled in accordance with a combination of an output of a toner consumption measuring means and an output of a toner transfer quantity measuring means so that the voltage of the electrophoresis electrode is controllable in accordance with a quantity of actually transferred toner particles, permitting a toner transfer with high reliability.

According to another species of the invention, a toner consumption measuring means estimates a toner consumption by counting a number of voltage pulses imposed on a discharge electrode in a unit time, permitting a stable measurement of toner consumption.

According to another species of the invention, a toner consumption measuring means estimates a quantity of consumed toner particles by measuring a current conducted between an opposing electrode and a grounded node in response to a discharge voltage pulse imposed on a discharge electrode, permitting a toner consumption to be estimated in accordance with an ink discharge, with a relatively high accuracy.

According to another species of the invention, there is employed a toner transfer quantity measuring means for measuring a discharge current of counter ions that is conducted through an electrophoresis electrode in correspondence to a quantity of transferred toner particles, to output a measurement result as a current toner transfer quantity to an electrophoresis voltage controller, where it is compared with a target toner transfer quantity to find a match therebetween for which an imposed voltage on an electrophoresis electrode is controlled, thus permitting an effective control with a high reliability, in particular for an optimum quantity of charged toner particles to be transferred to a vicinity of an ink outlet, in addition to that those counter ions generated in a region vicinal to the ink outlet are effectively dischargeable, preventing undesirable influences that otherwise might be imparted to an electric field between the electrophoresis electrode and a discharge electrode.

According to another species of the invention, an electrophoresis voltage control means controls a duration period of an imposed voltage on an electrophoresis electrode to thereby control a quantity of charged toner particles to be transferred, so that a voltage imposing circuit may be turned on and off to effect the voltage imposition on the electrophoresis electrode, permitting a facilitated fabrication of the voltage imposing circuit with a reduced cost.

According to another species of the invention, an electrophoresis voltage control means controls a voltage level of an imposed voltage on an electrophoresis electrode, permitting a fine and sharp control to be effected, besides a reduced burden on a voltage imposing circuit in comparison with an on-off control of a preset voltage.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An electrostatic ink jet recording device comprising:

an ink chamber for storing therein a volume of ink containing charged toner particles, the ink chamber having an ink outlet;

an opposing electrode connected to a grounded node, the opposing electrode disposed in opposition to the ink outlet with a sheet transfer route in between the ink outlet and the opposing electrode;

a discharge electrode provided in a vicinity of the ink outlet for developing a first electric field between the ink outlet and the opposing electrode to discharge a first quantity of charged toner particles from the ink chamber through the ink outlet as an ink jet;

an electrophoresis electrode positioned in a vicinity of the discharge electrode and the ink outlet for developing a second electric field between the electrophoresis electrode and the discharge electrode, to transfer a second quantity of charged toner particles in the ink chamber toward the ink outlet;

a first toner quantity measurer, associated with the ink chamber, which measures the first quantity of charged toner particles, as the first quantity of charged toner particles is discharged from the ink outlet;

a second toner quantity measurer, associated with the ink chamber, which measures the second quantity of charged toner particles, as the second quantity of charged toner particles is transferred toward the ink outlet; and a voltage controller, associated with said first and second toner quantity measurer, responsive to a combination of a measurement by the first toner quantity measurer and a measurement by the second toner quantity measurer, for controlling a voltage signal imposed on the electrophoresis electrode.

2. An electrostatic ink jet recording device according to claim 1, wherein said measurement of the first quantity of charged toner particles by the first toner quantity measurer is representative of a number of voltage pulses imposed on the discharge electrode.

3. An electrostatic ink jet recording device according to claim 1, wherein said measurement of the first quantity of charged toner particles by the first toner quantity measurer is representative of a current conducted between the opposing electrode and the grounded node.

4. An electrostatic ink jet recording device according to claim 1, wherein said measurement of the second quantity of charged toner particles by the second toner measurer is representative of a current conducted through the electrophoresis electrode.

5. An electrostatic ink jet recording device according to claim 1, wherein the voltage controller is operative for controlling an interval of time in which the voltage signal is kept imposed on the electrophoresis electrode.

6. An electrostatic ink jet recording device according to claim 1, wherein the voltage controller is operative for controlling a voltage level of the voltage signal imposed on the electrophoresis electrode.

7. An electrostatic ink jet recording device comprising:

an ink chamber for storing therein a volume of ink containing charged toner particles, the ink chamber having an ink outlet;

an opposing electrode connected to a grounded node, the opposing electrode disposed in opposition to the ink outlet with a sheet transfer route in between the ink outlet and the opposing electrode;

a discharge electrode provided in a vicinity of the ink outlet for developing a first electric field between the ink outlet and the opposing electrode to discharge a first quantity of charged toner particles from the ink chamber through the ink outlet as an ink jet;

an electrophoresis electrode positioned in a vicinity of the discharge electrode and the ink outlet for developing a second electric field between the electrophoresis electrode and the discharge electrode, to transfer a second quantity of charged toner particles in the ink chamber toward the ink outlet;

a toner consumption measurer, associated with the ink chamber, which measures the first quantity of charged toner particles, as the first quantity of charged toner particles is discharged from the ink outlet; and a voltage controller, associated with said toner consumption measurer, responsive to a measurement by the toner consumption measurer, for controlling a voltage signal imposed on the electrophoresis electrode.

8. An electrostatic ink jet recording device according to claim 7, wherein said measurement of the first quantity of charged toner particles by the toner consumption measurer is representative of a current conducted between the opposing electrode and the grounded node.

9. An electrostatic ink jet recording device according to claim 7, wherein said measurement of the first quantity of charged toner particles by the toner consumption measurer is representative of a number of voltage pulses imposed on the discharged electrode.

10. An electrostatic ink jet recording device according to claim 7, wherein the voltage controller is operative for controlling a voltage level of the voltage signal imposed on the electrophoresis electrode.

11. An electrostatic ink jet recording device according to claim 7, wherein the voltage controller is operative for controlling an interval of time in which the voltage signal is kept imposed on the electrophoresis electrode.

12. An electrostatic ink jet recording device, comprising:

(a) a recording medium feed system for feeding a recording medium to a predetermined position;

(b) an ink jet recording head composed of an array of cellular head portions, each of said cellular head portions including:

(i) a body member;

(ii) an ink chamber disposed in said body member, said ink chamber having an ink outlet at a front end thereof, and having a rear region;

(iii) a discharge electrode arranged at a front region of said body member vicinal to the ink outlet; and (iv) an electrophoresis electrode arranged at the rear region of the ink chamber, wherein the ink jet recording head is arranged so that the ink outlet of the ink chamber of each of said cellular head portions of the ink jet recording head opposes the recording medium when the recording medium is in the predetermined position;

(c) an ink supply system for supplying a circulatable flow of ink, containing toner particles electrically charged in a polarity, through a fluid circuit including the ink chamber of each of said cellular head portions of the ink jet recording head; and (d) an electric field generation system operative for providing a selective one of the cellular head portions of the ink jet recording head with:

(i) a first potential field, developed between said front region of said body member vicinal to the ink outlet and an opposing region vicinal to the recording medium when the recording medium is in the predetermined position, to discharge a first quantity of the toner particles from the ink outlet onto the recording medium; and (ii) a second potential field, developed between said rear region of the ink chamber and said front region of said body member, to transfer a second quantity of the toner particles to said front region of said body member, wherein the electric field generation system comprises:

(i) an opposing electrode provided in said opposing region, kept in contact with the recording medium when the recording medium is in the predetermined position, and connected to a grounded node;

(ii) the discharge electrode of said each of said cellular head portions of said ink recording head;

(iii) the electrophoresis electrode of said each of said cellular head portion of said ink recording head; and (iv) an electric field controller for imposing a voltage signal and a voltage pulse on the electrophoresis electrode and the discharge electrode of the selective one of the cellular head portions of the ink jet recording head, respectively, to develop the first and second potential fields, wherein the electric field controller is responsive to a variation of the first quantity of the toner particles to control the voltage signal imposed on the electrophoresis electrode of the selective one of the cellular head portions so that the second quantity of the toner particles is controlled.

13. An electrostatic ink jet recording device according to claim 12, wherein the variation of the first quantity of the toner particles is detected by measuring a number of voltage pulses imposed on the discharge electrode of the selective one of the cellular head portions.

14. An electrostatic ink jet recording device according to claim 12, wherein the variation of the first quantity of the toner particles is detected by measuring an electric current conducted through the electrophoresis electrode of the selective one of the cellular head portions.

15. An electrostatic ink jet recording device according to claim 12, wherein the variation of the first quantity of the toner particles is detected by measuring an electric current conducted between the opposing electrode and the grounded node in response to the voltage pulse imposed on the discharge electrode of the selective one of the cellular head portions.

* * * * *